US006098982A

United States Patent [19]

Campusano

[11] Patent Number: 6,098,982

[45] Date of Patent: Aug. 8, 2000

[54] AMERICA'S CHESS

[76] Inventor: Roberto A. Campusano, 40 Russo St. Apt. 2nd-right, Providence, R.I. 02904

[21] Appl. No.: 09/082,107

[22] Filed: May 20, 1998

[51] Int. Cl.[7] ..... A63F 3/00

[52] U.S. Cl. ..... 273/261

[58] Field of Search ..... 273/260, 261

[56] References Cited

U.S. PATENT DOCUMENTS

| | | | |
|---|---|---|---|
| 3,761,093 | 9/1973 | Migliore | 273/260 |
| 3,829,099 | 8/1974 | Lucero | 273/260 |
| 4,856,789 | 8/1989 | Carlson | 273/261 |
| 4,927,157 | 5/1990 | Rühiluoma et al. | 273/260 |
| 5,197,742 | 3/1993 | Bendit | 273/239 |
| 5,280,913 | 1/1994 | Sirk | 273/261 |
| 5,328,187 | 7/1994 | De Marchi | 273/260 |
| 5,421,582 | 6/1995 | Ritter . | |
| 5,484,157 | 1/1996 | King | 273/260 |
| 5,647,593 | 7/1997 | Kamat et al. | 273/261 |
| 5,690,334 | 11/1997 | Duke | 273/261 |
| 5,692,754 | 12/1997 | Rostami | 273/261 |
| 5,735,523 | 4/1998 | Fioriglio | 273/261 |

*Primary Examiner*—William E. Stoll

[57] ABSTRACT

This invention is an American version of the game chess. It contains eight (8) pieces including the six (6) pieces from traditional chess namely the king, queen, bishops, knights, rooks, and the pawns. It is played on a special board with 104 equal squares. The main board contains 10 rows or ranks, 14 columns or files, and 4 squares located outside the main board that can only be access by the knight. The game contains two new chess pieces one is called the pontiff or pope. The other is a piece made-up of the combination of the chess rook and the new piece the pontiff, it is called a rook/pontiff. These two new pieces look and move different from any of the pieces in the game of chess. The object of the game is the same as in the traditional game of chess that is to maneuver the pieces in a battle against the opponent. One outcome of such battle is a "checkmate"; that is one of the players places the opponent's king in a position where it has to surrender. The other outcome of such battle is a "draw"; that is none of the players is able to place the opponent's king in "checkmate". When either of these two possible outcomes is reached the game is legally over.

1 Claim, 7 Drawing Sheets

AMERICA'S CHESS

BACKGROUND OF THE INVENTION

This invention relates to the game of chess, specifically it provides a new American version of the traditional game of chess that originated in Europe.

DESCRIPTION OF PRIOR ART

THE GAME OF CHESS

Traditional chess is a game of skill intended for two players. It is played on a square shape board divided into sixty four (64) equal squares arranged in an eight-by-eight matrix, or in eight rows of eight squares each. The rows of squares are called ranks. Columns of squares are called files. The squares are alternately light and dark colors, commonly white and green. Each column has four light and four dark squares, with a light square at one end and a dark square at the other end.

Each chess player has sixteen (16) movable pieces, namely, a king, a queen, two bishops, two knights two rooks or castles, and eight pawns. The movable chess pieces are typically white (or light) and black (or dark), corresponding to the light and dark squares on the board, and are arranged on the two horizontal rows of light and dark squares closest to each player.

Each player places the queen of the player's chosen or assigned color on the square of her own color nearest the center of the row closest to the player. The king is placed next to the queen on the other square nearest the center of the same row. The two bishops are placed on the same row and on the other squares next to the king and the queen. The two knights are placed on the same row on the two squares next to the bishops and the two rooks are placed at the end of the same row, beside to the knights. The eight pawns are placed on the eight squares of the next row.

According to the rules of traditional chess:

(1) The king moves one square in any direction and can capture any opponent's piece, except the king, by moving into the square occupied by the other piece, except the king cannot move into a square where the king would be vulnerable to capture by an opponent's piece.

(2) The queen moves in a straight line on the rank, the file, or diagonally in any direction and for any distance over unoccupied squares. The queen cannot jump over pieces. The queen captures an opponent's piece, except the king, by moving into the square occupied by that piece.

(3) The bishops move diagonally over unoccupied squares for any distance. Thus, one bishop of each player may only move on light squares and the other bishop may only move on dark squares. Bishops capture an opponent's piece, except the king, by moving into the square occupied by that piece.

(4) The knight move in an L-shape pattern, two squares for any distance in a straight line along a row or column and the one square at a right angle. A knight's move must end on a square the opposite color from the one on which it started. The knight is the only piece that may "jump" other pieces, but the piece over which the night jumps is not affected by the jump. The knight captures an opponent's piece, except the king, by ending its move on the square occupied by that piece.

(5) The rooks move in a straight line for any distance. The rooks cannot jump or move diagonally. The rooks capture an opponent's piece, except the king, by moving into the square occupied by that piece.

(6) The pawns move one square forward (toward the opponent), except the initial move of each pawn may be either one square or two squares forward. A pawn must move diagonally forward one square to capture an opponent's piece, except the king, occupying that square. The pawn cannot move diagonally except to capture an opponent's piece. If a pawn advances to the eighth rank (the rank at the opposite side of the board), the pawn may be exchanged for a queen, rook bishop, or knight of the same color without to the number and type of pieces then on the board.

(7) Each chess player can perform a move called a "castle" once in the game, except when the king is in check (attacked directly by the enemy), or if there are other pieces between the king and the rook, or if the king or rook have been previously moved, or if the king or rook must pass over or land on a square occupied or attacked by an opponent's piece. "Castling" transposes a player's king and one rook. The king is moved two squares to its right or left on one row toward one rook and that one rook is moved over the king and placed on the square beside the king in the same row.

A king is "checked" when it is vulnerable to capture by an opponent's piece. The player "checking" an opponent's king must say "check". To avoid "checkmate", and the end of the game, a king in "check" must either move out of the check, capture the attacking piece, or the defending player must move another piece in between the king in "check" and the attacking piece. If none of these things can be done, then the king is in "checkmate" and the game is over, or else it is a draw.

ABOUT THE GAME OF CHESS

Chess is a game that has been played for centuries and whose development has been closely documented and preserved as a track record for new players to follow. For centuries chess players have developed strategies of play for areas such as the opening game, game defenses, the middle game, and the game ending. Many of these strategies or systems of play became so famous that they took on life of their own and became standards of play for the new generations. So nowadays we have systems of play such as Ruy Lopes opening, Reti opening, English opening, Marshall Attack, queen's gambit, Sicilian defense, French defense, queen's Indian defense, and king's Indian defense among a few. There are also books on how to play every area of the game and magazines reporting the latest developments in the chess world. Although, these contributions and developments have been good for the game there are inevitable consequences that a game so old will suffer from being around for so long.

In the past there were pioneers, original thinkers, and philosophers of the game. In the present chess is so developed that new chess openings and defenses are rare. The game ending is so developed that professional players agree on "draws" from merely inspecting the positions of the pieces from the middle of the game and do not bother to play the game until the end. Also, game openings are so long that the moves go well into the middle game and the space for self-thinking is diminishing rapidly. Although, the game is challenging still there is a big part of it that has become mechanical. For example, when the world chess championship is played there are so many draws that physical exhaustion has become more of an important tool in the strategy to win the tournament. Moreover, information spreads so rapidly that systems created by the brightest chess minds are easily employed by mediocre players to defeat genuine prodigies of the game. It is time for a significant change to take place to revive authentic thinking in the game so players can unravel their imagination as in the times of Capablanca, Alekhine, Keres, Lasker, Murphy, Reti, Marshal, Bobinic, and so many other great players of this game.

OBJECTS AND ADVANTAGES

Accordingly, several objects and advantages of the present invention are:

(a) to provide modem chess players the opportunity to create new game strategies for the game openings, game defenses, middle games, and the game endings;

(b) to provide a new chess board that is non-squared consisting of 104 squares, ten ranks or rows, fourteen files or columns, and such board reflects the existence of secret pathways as in Ancient castles;

(c) to provide two new pieces namely a pontiff and a rook/pontiff with maneuvering capabilities different from any of the pieces of chess;

(d) to provide a concept of a triple piece using a rook and a pontiff to create a third piece called a rook/pontiff;

(e) to provide a new chess rule that allows the pontiff and the rook to "unhook"—that is to separate from their initial assembled position—or to "hook"—that is to go back to their assembled position;

(f) to provide twenty four (24) pieces for each player instead of sixteen (16) pieces in the game of chess;

(h) to provide eight (8) different kinds of pieces for each player instead of six (6) pieces in the game of chess;

(i) to provide an American version of the game of chess;

(j) to make chess more interesting and challenging to chess players of today;

(k) to provide computer scientist with a new challenge in the battle between men and machine;

Still further objects and advantages will become apparent from a consideration of the ensuing description and the drawings.

DRAWING FIGURES

In the drawings, closely related figures have the same number but different alphabetic suffixes.

Figure 8A:
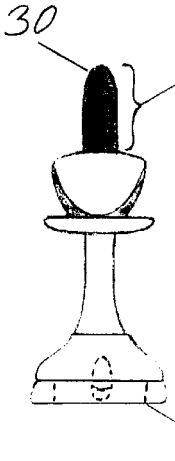
Figure 8B:
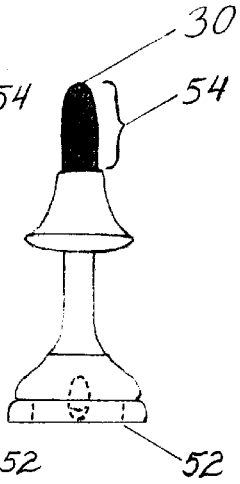
Figure 9:
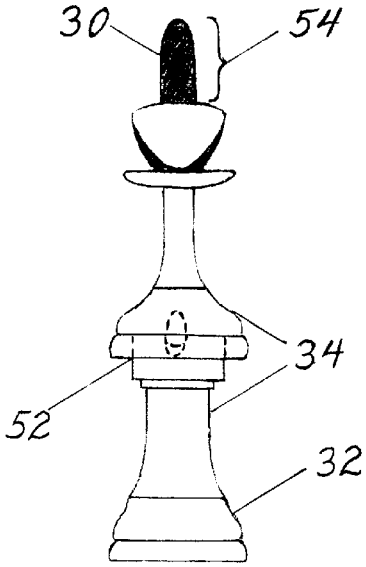
Figure 10:
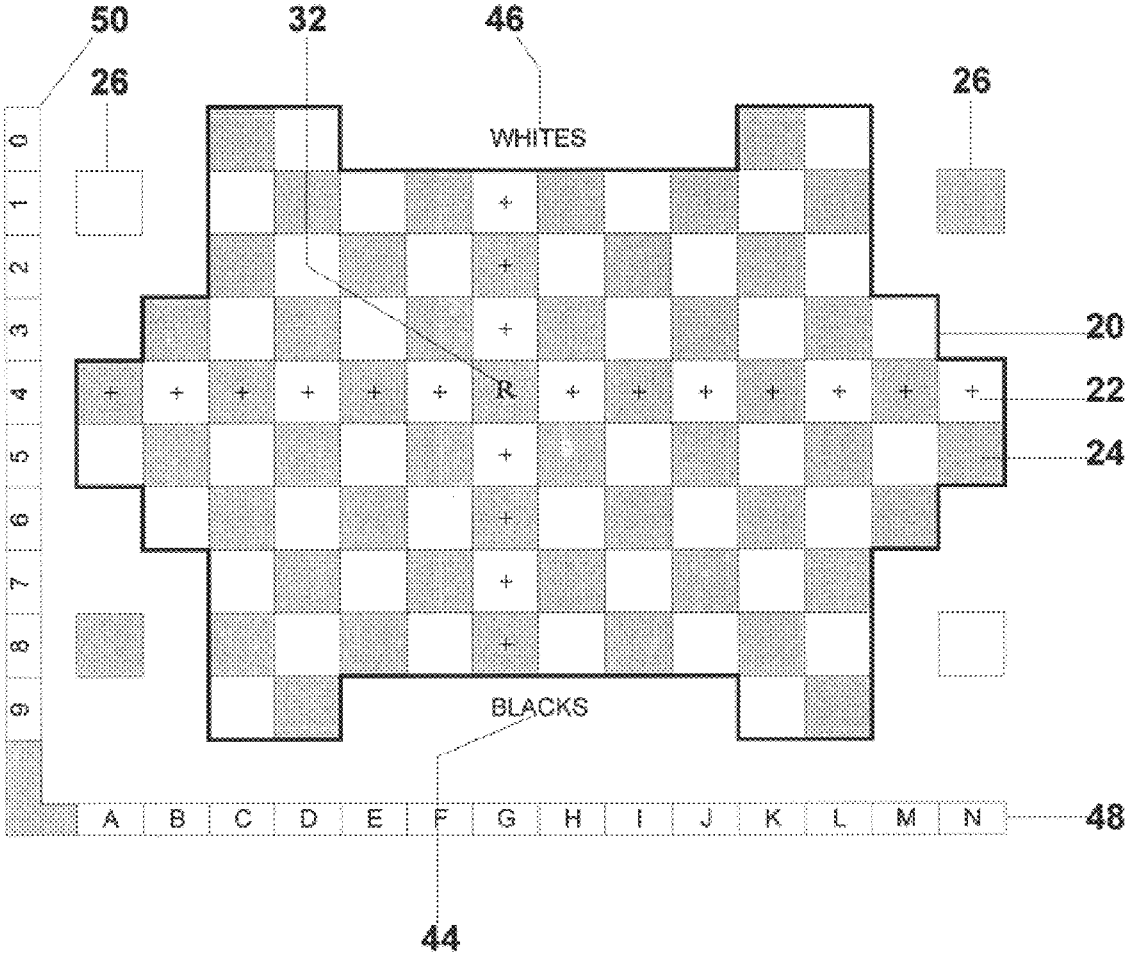
Figure 11:
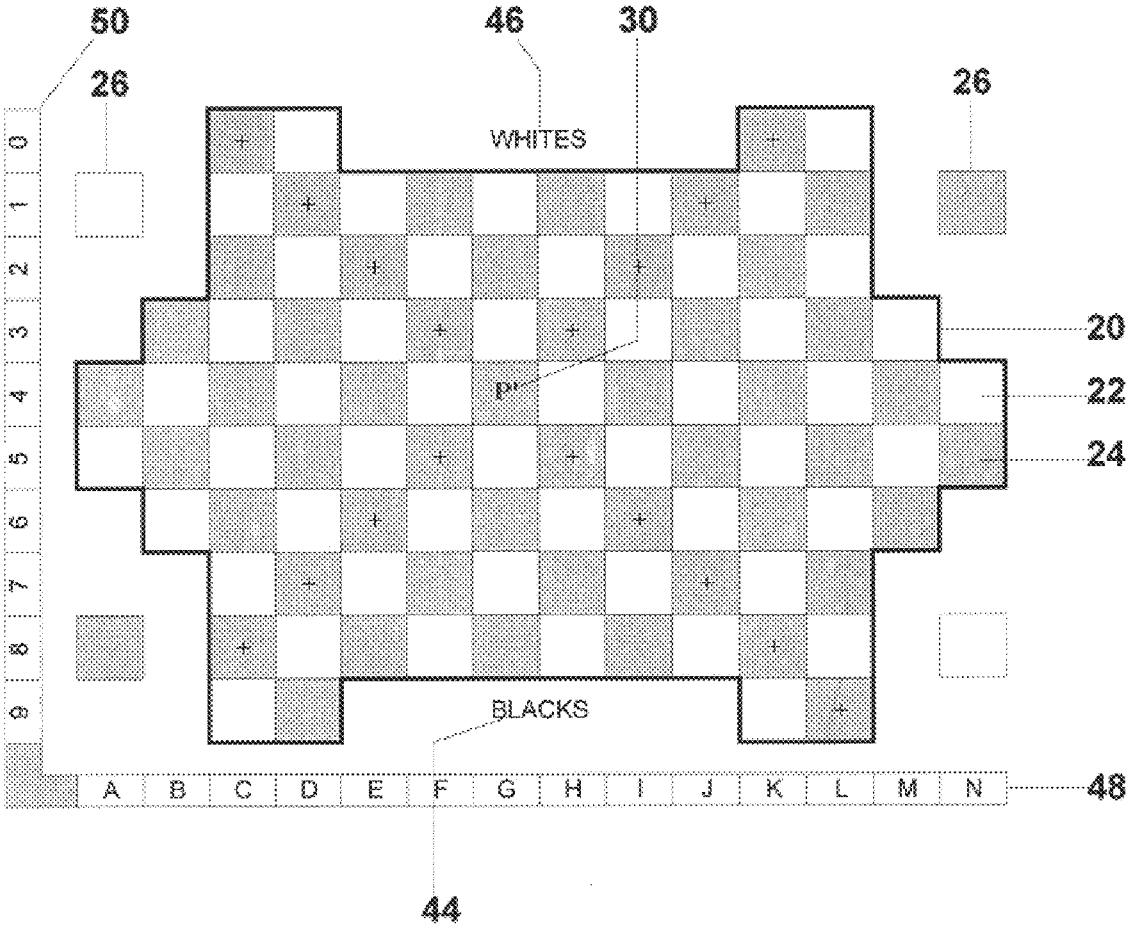
Figure 12:
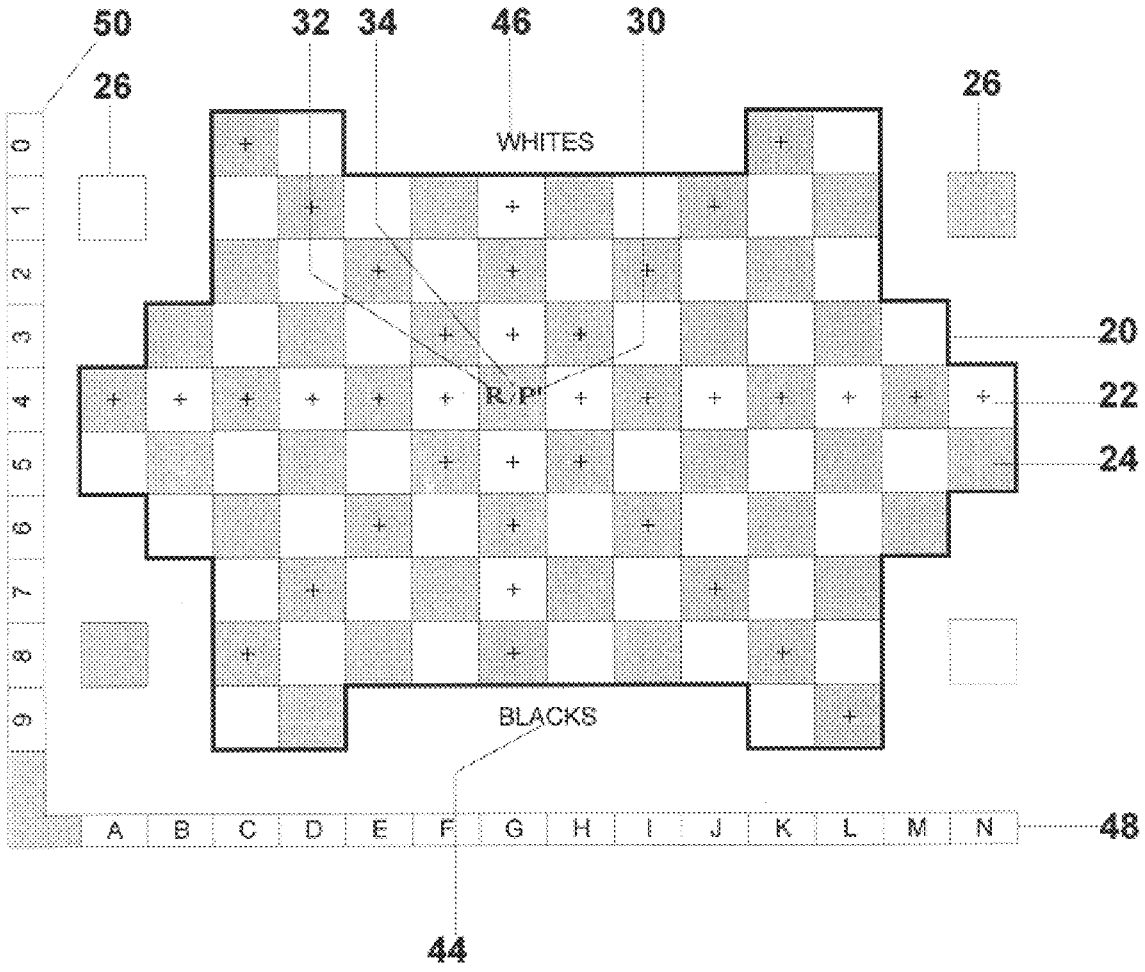
Figure 13:
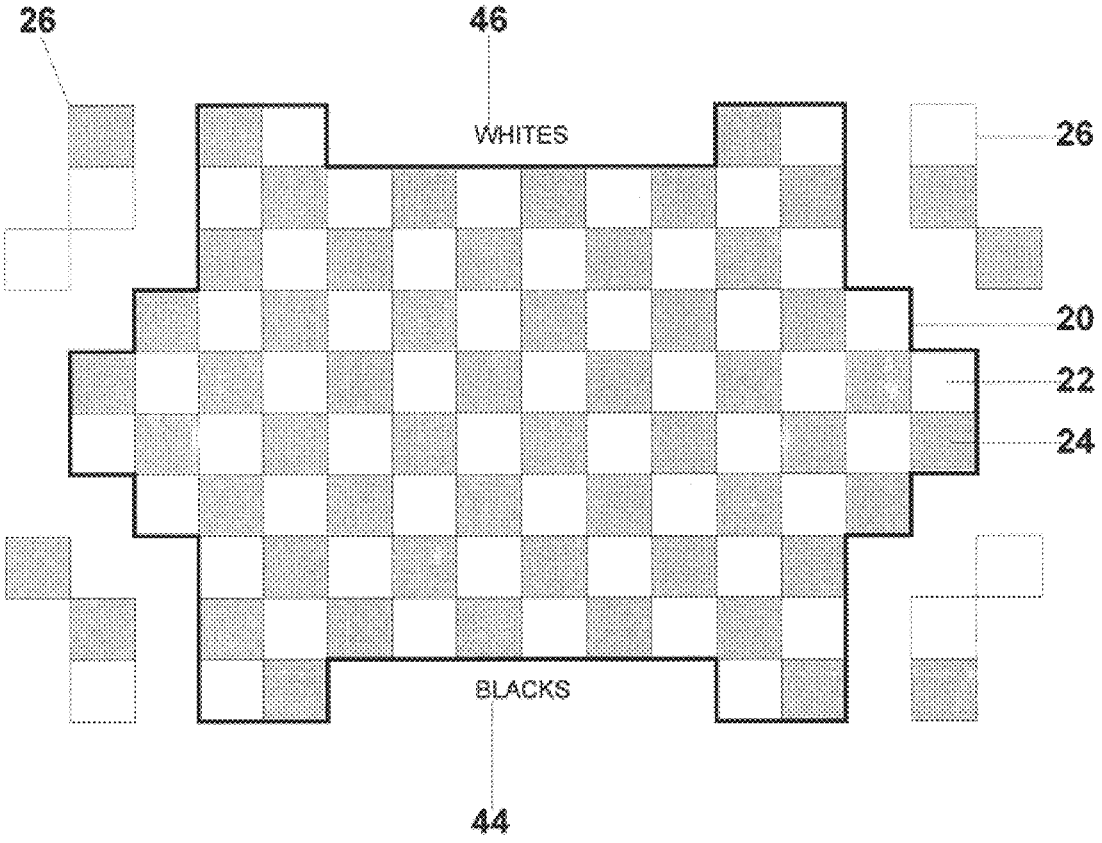
Figure 14:
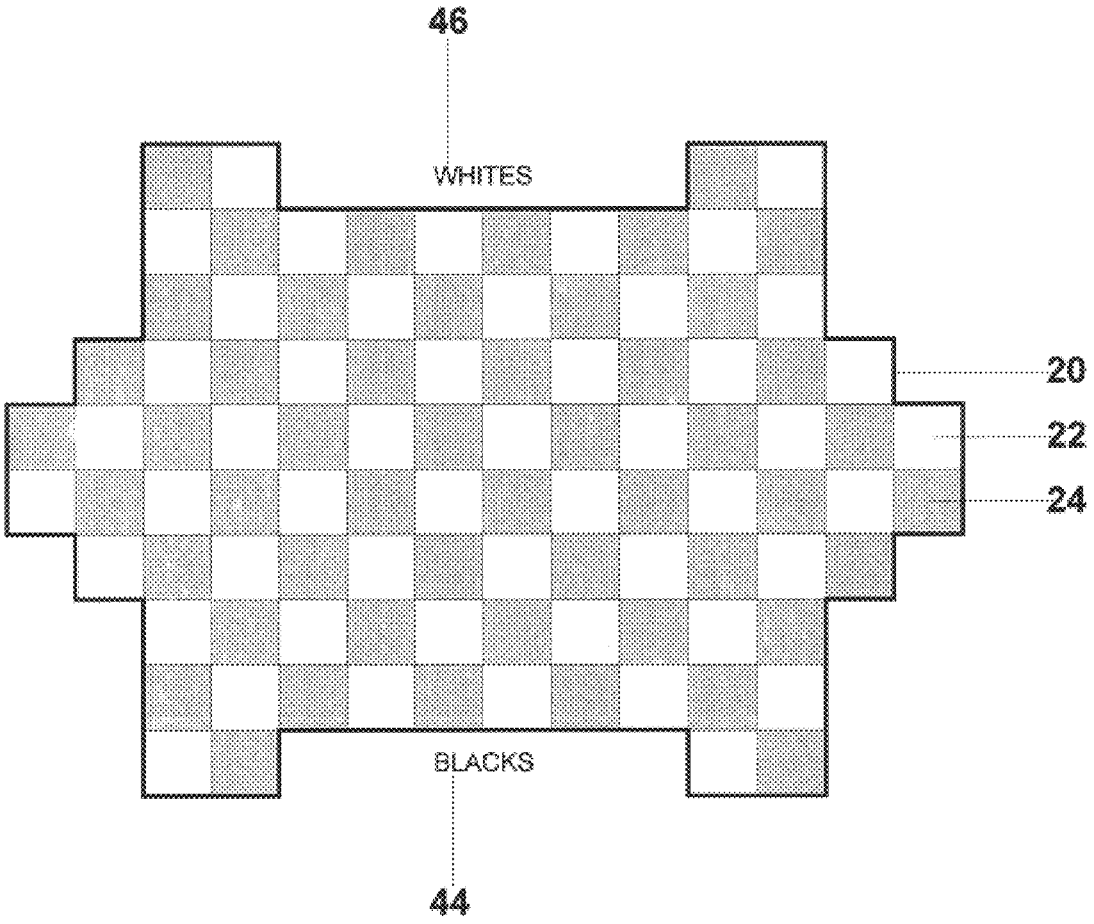

FIGS. 8*a*–8*b* are two views of the new chess piece the pontiff;

FIG. 9 is a view of the double piece the rook/pontiff in its initial position in the game;

FIG. 10 shows the movement of the rook as an independent piece;

FIG. 11 shows the movement of the pontiff as an independent piece;

FIG. 12 shows the movement of the combination piece rook/pontiff;

FIGS. 13–14 show alternate game boards where the new game can be played.

| Reference Numerals In Drawings | |
|---|---|
| 20 game board | 22 light square |
| 24 dark square | 26 square outside main board |
| 28 pawn | 30 pontiff |
| 32 rook | 34 rook/pontiff |
| 36 knight | 38 bishop |
| 40 queen | 42 king |
| 44 black pieces side of board | 46 white piece side of board |
| 48 letters used for the columns | 50 numbers used for the rows |
| 52 pontiff's connecting bottom to rook | 54 top part of the pontiff |

SUMMARY

This invention is an American version of the game chess. It contains eight (8) pieces including the six (6) pieces of chess and a non-squared board with 104 equal squares. The main board contains 10 rows or ranks, 14 columns or files, and 4 squares located outside the main board that can only be access by the knight. There are other boards where this game could be played included in FIGS. 13 and 14. The object of the game is the same as in traditional game of chess that is to maneuver the pieces in a battle to defeat the opponent. One outcome of such battle is a "checkmate"; that is one of the players places the opponent's king in a position where it has to surrender. The other outcome of such battle is a "draw"; that is none of the players is able to place the opponent's king in "checkmate". When either of these two possible outcomes is reached the game is legally over.

DETAILED DESCRIPTION OF THE INVENTION

America's chess is a game of skill intended for two players. It is played on a special board divided into one hundred four (104) equal squares arranged into a matrix of letters and numbers. Board 20 in the main embodiment in FIG. 1 contains 10 rows of squares a also called ranks and are labeled 50 using the numbers 0,1,2,3,4,5,6,7,8, and 9. The columns of squares of board 10 are called files and are labeled 48 in FIG. 1 using the following letters of the English alphabet A, B, C, D, E, F, G, H, I, J, K, L, M, and N. The squares are alternately light and dark colors, commonly white and green as in the traditional chess. All square or positions on the board have a unique coordinate identified by a letter and a number.

Each chess player has twenty four (24) movable pieces, namely, a king, a queen, two bishops, four knights, two rooks or castles, two rook/pontiff's, two pontiffs, and ten pawns. The movable chess pieces are typically white (or light) and black (or dark), corresponding to the light and dark squares on the board, and are arranged on rows one and two for the white pieces and on rows seven and eight for the black pieces (see FIG. 1, initial setup).

Figure 1:
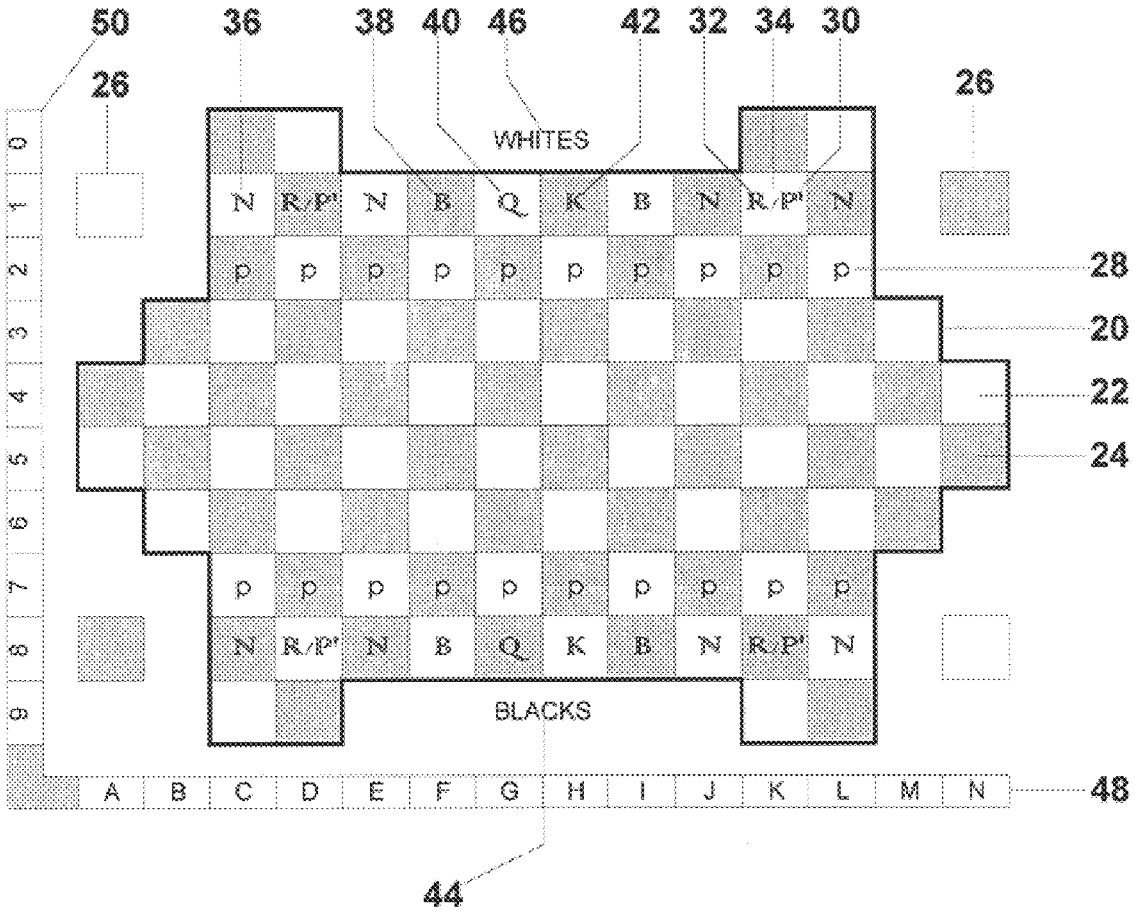
FIG. 1 is a plan view of the game board, showing the initial position of the pieces on the board.

Each player places the queen 40 of the player's chosen or assigned color on the square of her own color nearest the center of the row closest to the player (see FIG. 1). The white queen 40 goes on square G1 and the black queen 40 goes G8. The white king 42 is placed next to the queen on square HI and the black king 42 goes on square H8. The two white bishops 38 are placed on squares F1 and I1 next to the king and the queen. Similarly, the two black bishops 38 are placed on squares F8 and 18 next to their king and queen. The four white knights 36 are placed on row 1 squares C1, E1, J1, and L1. The four black knights 36 are placed on row 8 squares C8, E8, J8 and L8. The two white rooks are placed between knights one square D1 and the other K1. The black rooks go squares D8 and K8. The two white pontiffs 30 are placed on top of the rooks 32 initially on squares D1 and K1, and the two black pontiffs 30 go on squares D8 and K8 on top of the black rooks 32. The rook/pontiff's are combination or double pieces form by the powers of the rook and the pontiff, the two white rook/pontiff's 34 go on squares D1 and K1, and the two black rook/pontiff's 34 on squares D8 and K8. The ten white 28 pawns are placed on row 2 squares C2, D2, E2, F2, G2, H2, I2, J2, K2 and L2. Lastly, the ten black pawns 28 are placed on row 7 squares C7, D7, E7, F7, G7, H7, 17, J7 and L7.

Figure 2:
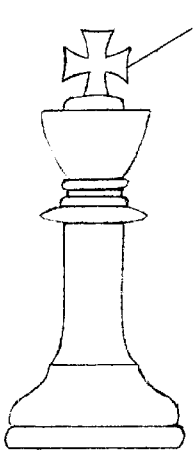
FIGS. 2–7 are views of the pieces in the game of chess that are present in the new game.

Rules of the game:

(1) The king 42 moves one square in any direction and can capture any opponent's piece, except the king, by moving into the square occupied by the other piece, except the king cannot move into a square where the king would be vulnerable to capture by an opponent's piece (see FIG. 2).

Figure 3:
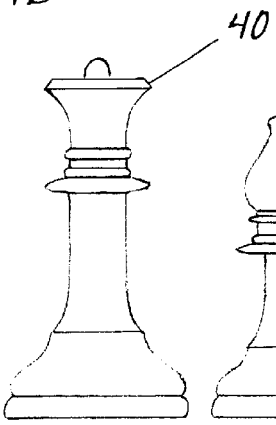

(2) The queen 40 moves in a straight line on the rank, the file, or diagonally in any direction and for any distance over unoccupied squares. The queen cannot jump over pieces. The queen captures an opponent's piece, except the king, by moving into the square occupied by that piece (see FIG. 3).

Figure 4:
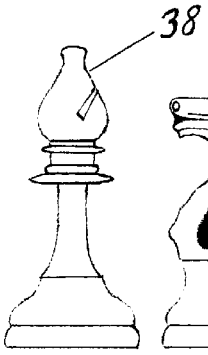

(3) The bishops 38 move diagonally over unoccupied squares for any distance. Thus, one bishop of each player may only move on light squares and the other bishop may only move on dark squares. Bishops capture an opponent's piece, except the king, by moving into the square occupied by that piece(see FIG. 4).

Figure 5:
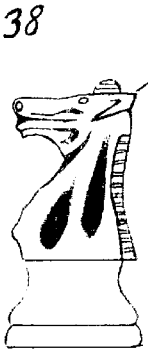

(4) The knight 36 move in an L-shape pattern, two squares for any distance in a straight line along a row or column and the one square at a right angle. A knight's move must end on a square the opposite color from the one on which it started. The knight is the only piece that may "jump" other pieces, but the piece over which the night jumps is not affected by the jump. The knight captures an opponent's piece, except the king, by ending its move on the square occupied by that piece. In addition, the knight is the only piece that because of its jumping capability can move into and out of the squares 16 that is A1, A8, N1, and N8 located outside the main board (see FIG. 5).

Figure 6:
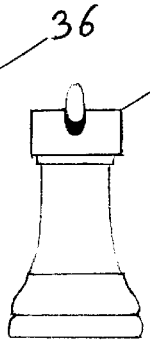

(5) The rooks 32 move in a straight line for any distance over unoccupied squares. The rooks cannot jump or move diagonally. The rooks capture an opponent's piece, except the king, by moving into the square occupied by that piece. In addition, the rook can perform an "unhook" move to separate from its initial assembled position with the pontiff, or a "hook" move to unify with the rook into the piece called the rook/pontiff at any point during the game (see FIG. 6).

(6) The pontiff 30 is a new chess piece that symbolizes the power of the pope in the ancient European world. The top of the white pontiff 54 is the colored black (dark) and the top of the black pontiff 54 is white (light) to symbolize the ability to "switch" diagonals. The pontiffs move diagonally over unoccupied squares for any distance. Unlike the bishop that is restricted to moving along the color squares of the diagonals of its initial position, the pontiff can switch the color squares of its diagonals repeatedly at any point during the game. To do this the pontiffs move one square over to any unoccupied squares of the color opposite the one where it is located. This is to say, that a pontiff can "switch" from a square 22 into square 24 and vice versa. This switch could can only be done from a white into black square or a black into a white square. A player cannot or it is not allowed to perform a switch move and take an opponent's piece at the same time: the switch move is intended solely for the purpose of exchanging the color of the diagonals of the pontiff. Pontiffs capture an opponent's piece, except the king, by moving into the square occupied by that piece located in the color square of its diagonal. In addition, the pontiff can perform an "unhook" move to separate from its initial assembled position with the rook, or a "hook" move to unify with the rook into the piece called the rook/pontiff at any point during the game (see FIG. 8 and 8*a*).

(7) The rook/pontiff 34 is a new chess piece made-up of the combination of the power of the rook and of the pontiff. It is a double piece that can be captured in one shot by an opponent's piece. An opponent's piece can capture the rook/pontiff by moving into the square that it occupies. In other words the opponent can take two the rook and the pontiff in a single move. The pontiff is hooked or screwed on top of the rook and in this position the rook can carry the pontiff alone with it any number or squares; but the pontiff cannot carry rook along with it. The rook/pontiffs' move in a straight line for any distance. The rook/pontiffs' capture an opponent's piece, except the king, by moving into the square occupied by that piece. Although the rook and the pontiff start up the game in this assembled position they can separate from each other by performing an "unhook" move. And in the case that the rook and the pontiff are already "unhooked" they can be joined together again by performing a "hook" move (see FIG. 9).

Figure 7:
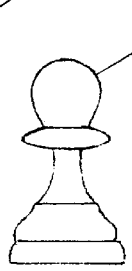

(8) The pawns 28 move one square forward (toward the opponent), except the initial move of each pawn may be either one square or two squares forward. A pawn must move diagonally forward one square to capture an opponent's piece, except the king, occupying that square. The pawn cannot move diagonally except to capture an opponent's piece. If a pawn advances to the end of a columns (or file) where is located, the pawn may be exchanged for a queen, rook, rook/pontiff, pontiff, bishop, or knight of the same color without regard to the number and type of pieces then on the board. Note: There are columns that are shorter than others. So, a pawn that happens to be located on column B has shorter distance to travel than a pawn located on column C, etc. FIG. 7 is a view of a typical chess pawn.

(9) Each chess player can perform a move called a "castle" once in the game, except when the king is in check (attacked directly by the enemy), or if there are other pieces between the king and the rook, or if the king or rook have been previously moved, or if the king must pass over or land on a square attacked by an opponent's piece. "Castling" transposes a player's king and one rook. The king is moved two squares to its right or left on one row toward one rook and that one rook is moved over the king and placed on the square beside the king in the same row.

Short "castle" for the whites: the white king 42 moves from square H1 to square J1 and the rook 32 goes from square K1 to square I1. Long "castle" for the whites: the white king moves from H1 to square F1 and the rook goes from square D1 to square G1. Conversely, short "castle" for blacks: the black king 42 moves from square H8 to square J8 and the rook 32 goes from square K8 to square I8. The long "castle" for blacks: the black king moves from H8 to square F8 and the rook goes from square D8 to square G8.

(10) Each player can perform a "unhook" move to separate the rook and the pontiff. This move can be initiated by either the rook or the pontiff at any point during the game. Similarly, each player can perform a "hook" move to unify the rook and the pontiff. This move also can be initiated by either the rook or the pontiff at any point during the game and the path of the piece that initiates the "hook" is not blocked by another piece.

The squares 26 that is A1, A8, N1 and N8 represent secret passage ways as in ancient castle, fortresses, and cities in the ancient world. Theses squares can only be accessed or used by the knight 36 because it is the only piece that has jumping capability. Although, these squares are located outside the main board, they are part of the playing field of this game. These squares are specially important for defensive maneuvering against attacking pieces.

A king is "checked" when it is vulnerable to capture by an opponent's piece. The player "checking" an opponent's king must say "check". To avoid "checkmate", and the end of the game, a king in "check" must either move out of the check, capture the attacking piece, or the defending player must move another piece in between the king in "check" and the attacking piece. If none of these things can be done, then the king is in "checkmate" and the game is over or else it is "draw".

OPERATION OF INVENTION

One of the features of this game is that new strategies have to be developed from the very beginning to the very end. In this game for example a player can attack the opponent with the single move of a pawn. If a white pawn is moved from E2 to E3 the pontiff 30 on D1 puts pressure on K7 (see FIG. 1). This illustrates that although this game contains more pieces than chess this game is more intense than chess.

Another feature of this game are files (columns) A, B, M and N of the new board 20 provide a new lateral dimension of attack not found on a squared chess board. So attacks on the corner ends of the board can happen from three different angles namely right diagonally, frontal, and left diagonally. In chess attacks on the corner ends of the board could on be carried out from a single diagonal and the front because of the limitations of a squared board. The impact of files A, B, M, and N is far more reaching than what it appears. If one counts the files from A to G or from H to N there are seven files in each section this is enough room to play two matches in two separate parts of the board in the same game. It is equivalent to fighting two battles in the same war. Chess only has eight files and that was enough to entertain us for hundreds of years.

Another important feature of this game is that it contains the structure and the pieces of chess. This mean that chess is literally the father of America's chess. It also means that America's chess inherits the developments in chess and takes chess to a new level. So most of the openings in chess would have to be significantly modified to be played in the new game.

About the pawns 28, the pawns in America's chess can become a stronger piece when they reach the end of their corresponding columns. This is important because in America's chess not all the columns have the same length. Unlike chess where the columns are all the same length, this becomes important in the middle game and the game ending of the new game. For example, not realizing that file B is only four squares long and file D is ten squares long could be a match winning advantage to a player.

Squares 26 that is squares A1, A8, N1, and N8 of board 20 FIG. 1 represent secret passage ways as in ancient castle. The main reason for this squares is to give knight a square to maneuver against attacks from opponent pieces coming from the files A, B, M and N. Also, ranks (rows) 0 and 9 play a similar roll in defensive maneuvering not only for the knight but for the king and any other piece on the board.

Lastly, the object of the game, America's chess, is for two players to maneuver their assigned piece in a battle against one another following the rules for limited movement of the pieces described above. The outcome of such encounter could be either a "checkmate" or a "draw". A "draw" could happen from repetition of position, stalemate, or player's agreement in the same way as in the rules of the game of chess.

CONCLUSION, RAMIFICATION, AND SCOPE OF INVENTION

Accordingly, this invention is an attempt to recover what the game of chess has lost throughout time. Players will once again have the opportunity to create individual systems of play for which they will become recognized and revered. And, authentic thinking will take on a more significant meaning. It is also a goal of this invention to give America its own identity in the chess world.

While my above description contains many specifities, these should not be construed as limitations on the scope of the invention, but rather as an exemplification of one preferred embodiment thereof. Many other variations are possible. For example, FIGS. 13 and 14 are examples of game boards where this game could also be played.

Accordingly, the scope of this invention should be determined not by the embodiment(s) illustrated, but by the appended claims and their legal equivalents.

I claim:

1. A method for two players to play a new game of chess, said method comprising the steps of:

(a) providing a board with one hundred and four alternately colored light and dark squares, said board consisting of ten rows and fourteen columns, (i) the shorter rows of said board consisting of four alternately colored light and dark squares;

(ii) the longer rows of said board consisting of fourteen alternately colored light and dark squares;

(iii) the shorter columns of said board consisting of four alternately colored light and dark squares;

(iv) the longer columns of said board consisting of ten alternately colored light and dark squares;

(b) providing twenty two game pieces for each player, (i) game pieces of one player being distinguishable from the game pieces of the other player;

(ii) the twenty two pieces for each player comprising one king, one queen, two bishops, four knights, and two rooks;

(iii) the twenty two pieces for each player comprising a set of two pieces different from any of the pieces in the game of chess, said set of pieces containing means to be mounted on top of other pieces;

(iv) the twenty two pieces for each player making up another set of two pieces, said another set of pieces being made-up of the combination of two separate pieces in the game, said another set of pieces being different from any of the pieces in the game of chess, and said another set of pieces being different from the set of pieces introduced in section (b)(iii) above;

(c) providing rules governing limited movement of the pieces, wherein:

(i) the rules for movement for the king, queen, bishops, knights, rooks, and the pawns are the same as in the game of chess and (ii) the rules for movement for the set of pieces introduced in section (b)(iii) being different than the chess rules for movement of any of the game pieces in the game of chess;

(iii) the rules for movement for the set of pieces introduced in section (b)(iv) being different from the set of rules for movement of any of the game pieces in the game of chess;

(iv) the rules for movement for the set of pieces introduced in section (b)(iv) being different from the set of rules for movement of the set of pieces introduced in section (b)(iii);

(v) a "hook" is a move whereby two separate independent pieces get mounted one on top of the other to operate as one piece;

(vi) an "unhook" is a move whereby a piece made-up of two separate pieces, where one is mounted on top of the other, separate from each other to operate as independent pieces;

(d) placing the pieces of each player on the board so that the pieces for one player occupy the second and third rows on one side of the board and the pieces for the other player occupy the second and third rows on the opposite side of the board;

(e) the players moving in alternate turns one piece at a time according to the rules governing the limited movement of the game pieces: and (f) continuing to move the pieces in alternate turns until the king is placed on "checkmate" and the other player declares victory or until both players declare a "draw".

* * * * *